US005320687A

United States Patent [19]

Kipphut et al.

[11] Patent Number: 5,320,687

[45] Date of Patent: Jun. 14, 1994

[54] EMBRITTLEMENT RESISTANT STAINLESS STEEL ALLOY

[75] Inventors: Christine M. Kipphut, Clifton Park; Joseph J. Pepe, Ballston Lake; Robin C. Schwant, Pattersonville, all of N.Y.

[73] Assignee: General Electric Company, Schenectady, N.Y.

[21] Appl. No.: 936,090

[22] Filed: Aug. 26, 1992

[51] Int. Cl.[5] ..... C22C 38/40

[52] U.S. Cl. ..... 148/325; 420/41; 420/69

[58] Field of Search ..... 420/41, 69; 148/325

[56] References Cited

U.S. PATENT DOCUMENTS 4,850,187 7/1989 Siga et al. ..... 148/325

OTHER PUBLICATIONS

Jaffe et al, Transactions of the ISS, "Development of Superclean 3.5 NiCrMov Low Pressure Steam Turbine Rotor Forging Steel", Feb. 1989.

ASTM-A565-est. 1991, pp. 358-360 "Standard Specification for Martensitic Stainless Steel".

*Primary Examiner*—Deborah Yee

*Attorney, Agent, or Firm*—Robert C. Lampe, Jr.; James E. McGinness; Charles T. Watts

[57] ABSTRACT

A high purity martensitic stainless steel alloy containing only critically limited amounts of minor elements including manganese, silicon, tin, phosphorus, aluminum, antimony and arsenic has high strength and toughness and unique resistance to both reversible and irreversible embrittlement.

3 Claims, 2 Drawing Sheets

EMBRITTLEMENT RESISTANT STAINLESS STEEL ALLOY

FIELD OF THE INVENTION

The present invention relates generally to martensitic alloys and is more particularly concerned with new high purity stainless steel with high strength and toughness and unique resistance to both reversible and irreversible embrittlement.

BACKGROUND OF THE INVENTION

Martensitic stainless steels having excellent strength, low brittle to ductile transition temperature and good hardening characteristics in thick sections have long been used as gas turbine wheel materials. They are, however, subject to embrittlement on exposure to elevated temperatures due to formation of detrimental phases within the alloy grains (irreversible embrittlement) or due to segregation of some harmful elements to the grain boundaries (reversible embrittlement). Recognizing this problem, others have added molybdenum, cobalt and other strong carbide formers which limit the tendency toward irreversible embrittlement. While a degree of success has thus been gained, the problem of reversible embrittlement remains, as heat treatments to relieve the condition may degrade desired properties and dimensional integrity of the products. Also, changes in alloy chemistry, particularly phosphorus content, yielded results indifferent enough to discourage special measures for phosphorus removal.

SUMMARY OF THE INVENTION

In accordance with this invention, based on our discoveries set forth below, a new stainless steel alloy called High Purity M152 (HP M152) is provided which has all the desired properties of those of the prior art, but has unique resistance to embrittlement. Further, this new alloy imposes no mechanical- or corrosion- resistant property penalty and involves only a modest increase in cost. Consequently, this alloy can be used to special advantage in steam turbine and jet engine applications, as well as in gas turbines.

In making this invention we discovered that the shortcomings of the prior art described above can be overcome by reducing the relatively small amounts of some minor constituents of stainless steel alloys. Limiting phosphorus, tin, antimony and arsenic to a little more than trace amounts, provides tremendous reduction in the amount of embrittlement which occurs. The importance of phosphorus in this system is striking in view of the earlier experience noted above. Additionally, reduction of the manganese and silicon contents from 0.7 and 0.3, respectively, to about 0.050% provides further benefit.

We have also found that the new results and advantages of this invention can consistently be obtained with such alloy in which the manganese, silicon and the other minor constituents are in amounts varying from those stated above. Thus, while the ideal alloy of this invention contains essentially none of these various elements just mentioned, as a practical matter in commercial use or production, all of them will be present in some detectable quantity without significant detriment to the desired properties provided no minor element is present in excess of the maxima set out below.

Briefly stated, alloy compositions within the purview of this invention and therefore within the scope of the appended claims include the following:

| Element | Base Material Wt % |
|---|---|
| C | 0.08–0.15 |
| S | 0.004 max |
| Cr | 11.00–12.50 |
| V | 0.25–0.40 |
| Mo | 1.50–2.00 |
| Ni | 2.5–3.10 |
| Al | 0.001–0.027 |
| Mn | 0.03–0.13 |
| Fe | Balance |
| P | 0.01 max |
| Si | 0.010–0.10 |

As a matter of our present preference, an alloy of this invention does not contain more than about 0.050% manganese, 0.050% silicon, 0.0020% phosphorus, 0.0010% tin, 0.0005% antimony, 0.0030% arsenic.

BRIEF DESCRIPTION OF THE DRAWINGS

In the drawings accompanying and forming a part of this specification.

DETAILED DESCRIPTION OF THE PREFERRED EMBODIMENTS

Because as indicated above and described in detail below, particularly in reference to FIGS. 1 and 2, the composition of these new alloys of this invention is critical in that small changes can result in major differences in desirable properties, the formulation of these alloys and production thereof are carried out with special care. Thus, in the best melting and casting practice these alloys are made by bringing together the alloy constituents in a state of refinement or purity such that the ultimate alloy content of minor constituents is carefully controlled and limited. While chemically pure alloy constituents would be desirable, for reasons of economy they are not used. Instead the selection of the major elements is made so that the aggregate content of the alloy minor elements does not exceed the limits described above and set forth in the appended claims.

A consequence of failure to exercise such control is the loss of major advantages of this invention to a significant extent. The embrittlement characteristics of the resulting alloys can, for example, be substantially adversely affected if the limits of the minor elements are exceeded. As a practical matter, an excess of any one or more of the minor elements could not be corrected without remelting the alloy and adjusting the melt chemistry in accordance with the present invention.

Figure 1:
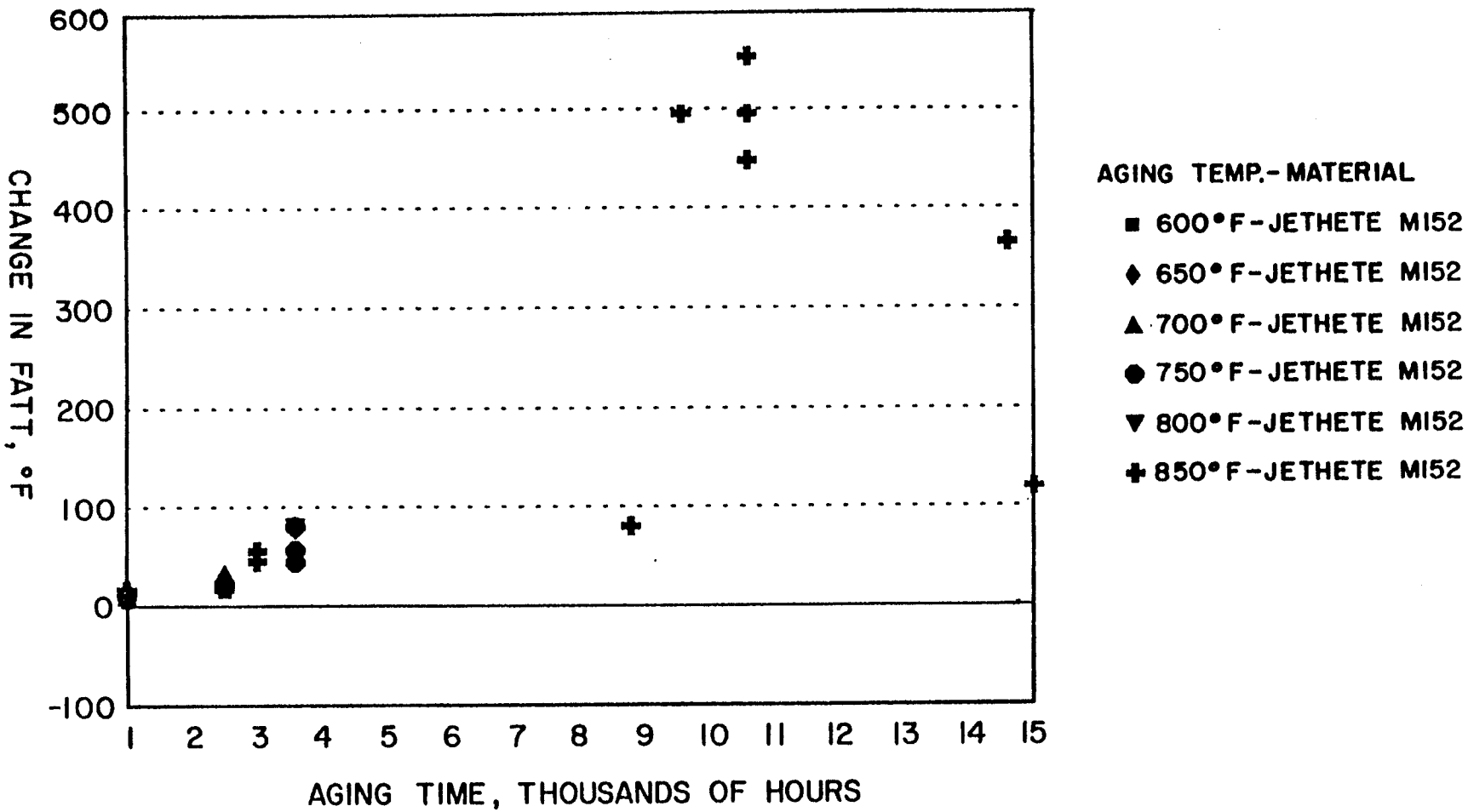
FIG. 1 PRIOR ART
FIG. 1 is a chart on which fracture appearance transition temperature (FATT) is plotted against aging time in thousands of hours for data gathered in tests of a prior art stainless steel alloy of this general type as described below.
Figure 2:
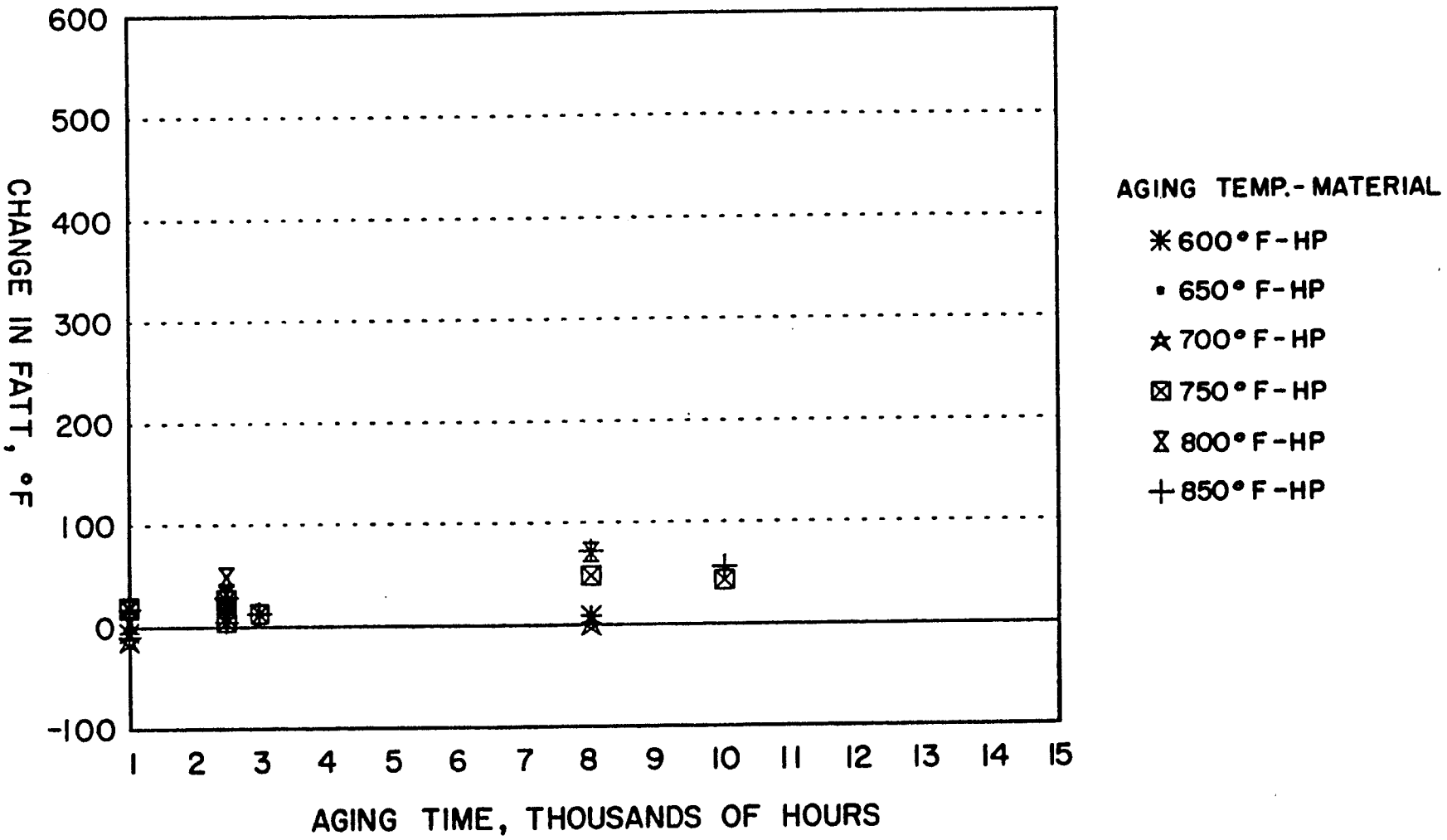
FIG. 2 is a chart like that of FIG. 1 showing aging time data gathered in tests on an alloy of this invention as described below.

The differences in property levels of major importance between the alloys of this invention and the prior art alloys of basically similar chemistry are graphically illustrated in FIGS. 1 and 2. The change in FATT is used as the primary measurement of embrittlement and is a method of estimating the fracture toughness of an alloy by measuring the Fracture Appearance Transition Temperature (FATT). The FATT is the temperature at which a Charpy V-Notch impact specimen will break and exhibit 50% brittle fracture. The higher the FATT, the less ductile the material is, and the lower the fracture toughness.

Embrittlement is quantified by measuring the change in FATT which results from aging at elevated temperatures. The FATT of a material is measured prior to temperature exposure, when first produced. This value is called the As-Received FATT. To age material for studies, test blocks are placed in a furnace at the desired aging temperature. After a period of aging time at temperature, the test block is removed and the FATT is measured. If embrittlement has occurred, the aged FATT will be substantially higher than the As-Received FATT. The difference in values of the two measurements (Aged FATT)−(As-Received FATT) is referred to as the Delta FATT. The higher the Delta FATT, the more embrittlement.

As illustrated by the data points and the extreme variations between them in the two cases, particularly in the 10,000-hour region, the alloys of this invention show excellent resistance to embrittlement relative to prior art alloys.

Cast and fabricated bodies of alloys of this invention, in contrast to those made of the 12-chromium stainless steels of the prior art, can as a result of their resistance to embrittlement illustrated in the drawings, be used for much longer times at temperatures above 600° F. without suffering from excessive reduction in toughness due to embrittlement. Gaining this advantage without sacrificing other desirable properties and at only a moderate increase in cost of production constitutes an important advance in the art.

Products made using these new alloys of this invention are suitably produced in accordance with the practice in art. Gas turbine wheels thus are cast and forged to shape and size by technique presently in general use.

Those skilled in the art will gain a further and better understanding of this invention and its important new advantages and results from the following illustrative, but not limiting, detailed accounts of actual experimental operations.

EXAMPLE I

Gas turbine sized disks were made from a commercial prior art 12- chromium martensitic stainless steel alloy (JETHETE M 152) of the following nominal analysis:

| | |
|---|---|
| Carbon | 0.10 |
| Chromium | 12.0 |
| Manganese | 0.7 |
| Silicon | 0.3 |
| Molybdenum | 1.8 |
| Nickel | 2.4 |
| Phosphorus | 0.025 |
| Vanadium | 0.35 |
| Sulphur | 0.025 |
| Iron | Balance |

Test pieces from these disks were subjected to the FATT embrittlement test procedure described above at temperatures and times as set forth the following table:

TABLE I

| Sample | Age Temperature (°F.) | Age Time x1E-3 (hrs) | Embrittled DELTA FATT (°F.) |
|---|---|---|---|
| A | 500 | 1.0 | −12 |
| A | 500 | 2.5 | 1 |
| B | 500 | 1.0 | −2 |
| B | 500 | 2.5 | 9 |
| A | 600 | 1.0 | 5 |
| A | 600 | 2.5 | 17 |
| B | 600 | 1.0 | 11 |
| B | 600 | 2.5 | 15 |
| A | 650 | 1.0 | 11 |
| A | 650 | 2.5 | 18 |
| B | 650 | 1.0 | 14 |
| B | 650 | 2.5 | 26 |
| C | 675 | 17.5 | 88 |
| D | 675 | 17.5 | 114 |
| A | 700 | 1.0 | 15 |
| A | 700 | 2.5 | 22 |
| B | 700 | 1.0 | 10 |
| B | 700 | 2.5 | 33 |
| B | 750 | 3.576 | 44 |
| B | 750 | 28.0 | 121 |
| E | 750 | 3.576 | 56 |
| E | 750 | 28.0 | 154 |
| F | 750 | 28.0 | 168 |
| G | 750 | 3.576 | 80 |
| G | 750 | 28.0 | 163 |
| H | 750 | 24.1 | 105 |
| H | 750 | 56.9 | 130 |
| I | 750 | 28.0 | 144 |
| A | 750 | 1.0 | 12 |
| A | 750 | 2.5 | 23 |
| B | 750 | 1.0 | 12 |
| B | 750 | 2.5 | 19 |
| J | 800 | 3.576 | 81 |
| J | 800 | 28.0 | 198 |
| K | 800 | 28.0 | 147 |
| L | 800 | 28.0 | 161 |
| M | 800 | 3.576 | 76 |
| M | 800 | 17.5 | 211 |
| N | 800 | 28.0 | 167 |
| O | 850 | 18.7 | 349 |
| O | 850 | 50.4 | 520 |
| P | 850 | 17.6 | 350 |
| P | 850 | 50.4 | 458 |
| Q | 850 | 56.0 | 250 |
| Q | 850 | 90.0 | 293 |
| R | 850 | 25.0 | 306 |
| S | 850 | 21.0 | 449 |
| T | 850 | 21.0 | 550 |
| T | 850 | 50.4 | 597 |
| U | 850 | 18.7 | 253 |
| U | 850 | 50.4 | 514 |
| V | 850 | 18.7 | 331 |
| V | 850 | 50.4 | 488 |
| W | 850 | 10.6 | 447 |
| X | 850 | 3.0 | 45 |
| X | 850 | 8.8 | 80 |
| X | 850 | 15.0 | 120 |
| X | 850 | 40.00 | 160 |
| Y | 850 | 14.6 | 365 |
| Z | 850 | 9.6 | 495 |
| AA | 850 | 10.6 | 555 |
| AB | 850 | 10.6 | 495 |
| AC | 850 | 1.0 | 16 |
| AC | 850 | 3.0 | 55 |

Representative data from this TABLE I appears on the chart of FIG. 1. Only test data obtained in less 15,000 hours are shown.

EXAMPLE II

Two gas turbine sized disks and one trial forging of the allow HP 152 of the present invention were prepared to provide test specimens for use in the manner described in Example I. The data resulting is set out in the following table, representative data items being entered on FIG. 2.

TABLE II

| Sample ID | Age Temperature (°F.) | Age Time x1E-3 (hrs) | Embrittled DELTA FATT (°F.) |
|---|---|---|---|
| Trial Forging | 750 | 1.0 | 20 |
| Trial Forging | 750 | 3.0 | 13 |
| Trial Forging | 750 | 10.0 | 43 |
| Trial Forging | 850 | 1.0 | −9 |
| Trial Forging | 850 | 3.0 | 13 |
| Trial Forging | 850 | 10.0 | 56 |
| Disk #1 | 500 | 1.0 | −7 |
| Disk #1 | 500 | 2.5 | −17 |
| Disk #1 | 600 | 1.0 | −5 |
| Disk #1 | 600 | 2.5 | 10 |
| Disk #1 | 600 | 8.0 | 9 |
| Disk #1 | 650 | 1.0 | 4 |
| Disk #1 | 650 | 2.5 | 16 |
| Disk #1 | 650 | 8.0 | 7 |
| Disk #1 | 700 | 1.0 | −14 |
| Disk #1 | 700 | 2.5 | 25 |
| Disk #1 | 700 | 8.0 | −1 |
| Disk #1 | 750 | 1.0 | 18 |
| Disk #1 | 750 | 2.5 | 5 |
| Disk #1 | 750 | 8.0 | 48 |
| Disk #1 | 800 | 1.0 | 6 |
| Disk #1 | 800 | 2.5 | 49 |
| Disk #1 | 800 | 8.0 | 71 |
| Disk #1 | 850 | 1.0 | 18 |
| Disk #1 | 850 | 2.5 | 29 |
| Disk #1 | 850 | 8.0 | 72 |
| Disk #2 | 750 | 2.5 | 27 |
| Disk #2 | 800 | 2.5 | 33 |
| Disk #2 | 850 | 2.5 | 5 |

As is evident from the tables and from the data shown on FIGS. 1 and 2, the new alloys of this invention are far superior to the comparable prior art alloys in respect to resistance to embrittlement and thus in terms of useful service life in gas turbine, steam turbine and jet engine environments.

In the specification and the appended claims, wherever percentage or proportion is stated, reference is to the weight basis unless otherwise expressly noted.

We claim:

1. A high purity martensitic stainless steel having unique resistance to embrittlement in addition to excellent strength, low brittle to ductile transition temperature and good hardening characteristics and consequently having special utility in gas turbine, steam turbine and jet engine applications consisting essentially of, by weight,

| | |
|---|---|
| Carbon | 0.08–0.15 |
| Manganese | 0.03–less than 0.10 |
| Silicon | 0.01–0.10 |
| Chromium | 11.00–12.50 |
| Molybdenum | 1.50–2.00 |
| Nickel | 2.00–3.10 |
| Vanadium | 0.25–0.40 |
| Phosphorus | 0.010 max. |
| Sulphur | 0.004 max. |
| Nitrogen | 0.060 max. |
| Hydrogen | 2 ppm max. |
| Oxygen | 50 ppm max |
| Aluminum | 0.001–0.025 |
| Arsenic | 0.0060 max |
| Antimony | 0.0030 max |
| Tin | 0.0050 max |
| Iron | Balance. |

2. The alloy of claim 1 containing not in excess of 0.050 manganese, 0.050 silicon, 0.0020 phosphorus, 0.0020 tin, 0.0010 antimony, 0.0030 arsenic.

3. The alloy of claim 1 containing not in excess of 0.050 manganese, 0.050 silicon, 0.0050 phosphorus, 0.0040 sulphur, 0.0050 tin, 0.0030 antimony, 0.0060 arsenic.

* * * * *